United States Patent [19]

Matsuura et al.

[11] Patent Number: 4,515,121

[45] Date of Patent: May 7, 1985

[54] VALVE DRIVING CONTROL APPARATUS IN AN INTERNAL COMBUSITON ENGINE

[75] Inventors: Masaaki Matsuura, Tokyo; Yoshikatsu Nakano, Kawagoe, both of Japan

[73] Assignee: Honda Giken Kogyo Kabushiki Kaisha, Tokyo, Japan

[21] Appl. No.: 445,638

[22] Filed: Nov. 30, 1982

[30] Foreign Application Priority Data

Dec. 3, 1981 [JP] Japan ..... 56-194816

[51] Int. Cl.[3] ..... F01L 1/34; F02D 13/06

[52] U.S. Cl. ..... 123/198 F; 123/90.16; 123/90.27

[58] Field of Search ..... 123/198 F, 90.15, 90.16, 123/90.27, 90.22, 90.23

[56] References Cited

U.S. PATENT DOCUMENTS

| | | | |
|---|---|---|---|
| 3,641,988 | 2/1972 | Torazza et al. | 123/90.16 |
| 3,911,879 | 10/1975 | Altmann | 123/90.16 |
| 4,203,397 | 5/1980 | Soeters, Jr. | 123/198 F |
| 4,237,832 | 12/1980 | Hartig et al. | 123/198 F |
| 4,245,596 | 1/1981 | Bruder et al. | 123/198 F |
| 4,256,070 | 3/1981 | Mueller | 123/198 F |
| 4,284,042 | 8/1981 | Springer | 123/198 F |
| 4,285,310 | 8/1981 | Takizawa et al. | 123/90.16 |
| 4,336,775 | 6/1982 | Meyer | 123/198 F |
| 4,337,738 | 7/1982 | Bubniak et al. | 123/198 F |
| 4,363,300 | 12/1982 | Honda | 123/90.27 |

*Primary Examiner*—Ira S. Lazarus

*Attorney, Agent, or Firm*—Pollock, Vande Sande and Priddy

[57] ABSTRACT

A valve driving control apparatus in an internal combustion engine comprises a plurality of power cylinders each having a plurality of intake and exhaust reciprocating valves which are made operative or inoperative depending upon the load conditions of the engine.

This apparatus selectively makes the valves operative or inoperative according to a control signal which is generated in a control circuit in response to the engine rotational speed. A part of the intake valves and a part of the exhaust valves are made inoperative in a low rotational speed range of the internal combustion engine. A part of the intake valves is made inoperative and all of the exhaust valves are made operative in a medium rotational speed range. All of the intake and exhaust valves are made operative in a high rotational speed range.

5 Claims, 6 Drawing Figures

VALVE DRIVING CONTROL APPARATUS IN AN INTERNAL COMBUSITON ENGINE

BACKGROUND OF THE INVENTION

The present invention relates to a valve driving control apparatus for driving intake and exhaust valves for an internal combustion engine, more particularly to a valve driving apparatus for an internal combustion engine which comprises a plurality of power cylinders each having a plurality of intake and exhaust reciprocating valves.

The applicant of the present invention has already proposed a valve driving system for providing an efficient drivability over the whole range of the rotational speed i.e., from high to low of the engine, in which each of the power cylinders is equipped with a plurality of intake and exhaust valves, wherein at least one of the intake valves and at least one of the exhaust valves are switched either operative or inoperative depending upon the load conditions of the engine.

In such a valve driving system as mentioned above, in which the change-over operation of the operative or inoperative state of the valve is performed at a predetermined rotational speed of the engine, the engine power may be discontinuous at the time of such a change-over operation. There is also a defect that comfortableness of the motor vehicle will be deteriorated due to the engine power fluctuation which occurs when the reciprocating valves are made operative or inoperative at the time of switching operation by the valve driving apparatus.

SUMMARY OF THE INVENTION

It is therefore an object of the invention to provide a valve driving control apparatus for an internal combustion engine by which the continuity of the engine output power is maintained even during the switching operation stated above is performed.

Another object of the invention is to provide a valve driving control apparatus which can eliminate a sudden change of the engine output power and to provide a high engine output power continuously from a low speed to a high speed of the engine.

The valve driving apparatus in an internal combustion engine according to the present invention is characterized in that at least one of the intake valves and at least one of the exhaust valves are made inoperative when the engine speed is low, at least one of the intake valves is made inoperative but the exhaust valves are made operative when the engine speed is, and all of the intake and exhaust valves are made operative when the engine speed is high.

BRIEF DESCRIPTION OF THE DRAWINGS

The invention will now be better understood from the following description with reference to the accompanying drawings, in which.

DESCRIPTION OF THE PREFERRED EMBODIMENT

Figure 1:
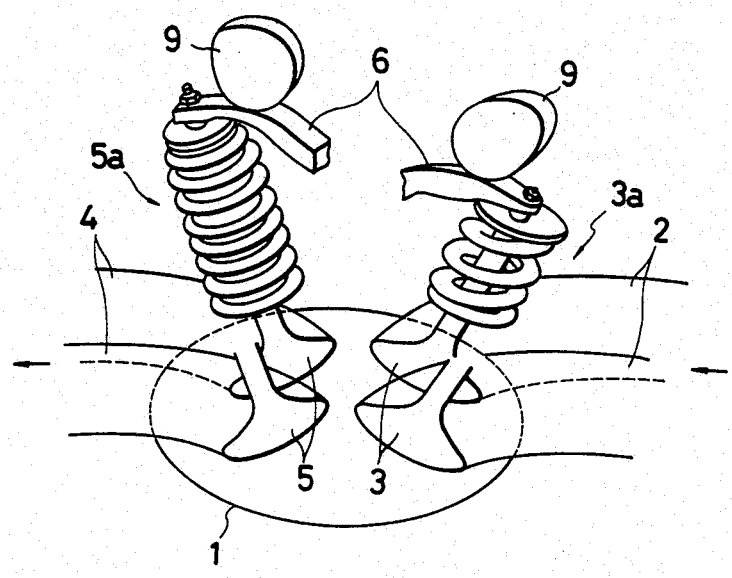
FIG. 1 is a perspective view illustrating a part of an internal combustion engine which is equipped with a plurality of intake and exhaust valves to be driven by the valve driving control apparatus of the invention.
Figure 2:
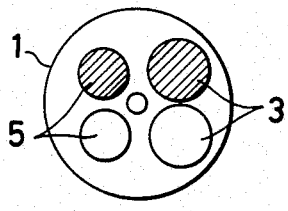
FIG. 2 is a view showing an arrangement of the intake/exhaust valve assembly of FIG. 1.

FIG. 1 shows a part of the internal combustion engine which is equipped with two intake valves and two exhaust valves per each power cylinder. A reference numeral 1 denotes a power cylinder in which there are arranged in parallel two intake valves 3 which open and close two corresponding intake ports 2 which open into the power cylinder 1, and two exhaust valves 5 which open and close two corresponding exhaust ports 4. The intake valves 3 and the exhaust valves 5 are respectively urged by appropriate bias mechanisms 3*a* and 5*a* so as to close the intake and exhaust ports 2 and 4. These valves are driven by means of cam followers 6 associated with cams 9 which are engaged with the top portions of the respective valve assemblies so that the valves can intermittently open in accordance with the rotation of a crankshaft (not shown). A supporting end portion (not shown) of each of the cam followers 6 is pivotally supported by means of an appropriate support mechanism, which enables the switching operation between the operative and inoperative states, i.e., one of the intake valves 3 and/or one of the exhaust valves 5 are controlled operative or inoperative in response to the driving conditions of the engine as shown in FIG. 2.

Figure 3:
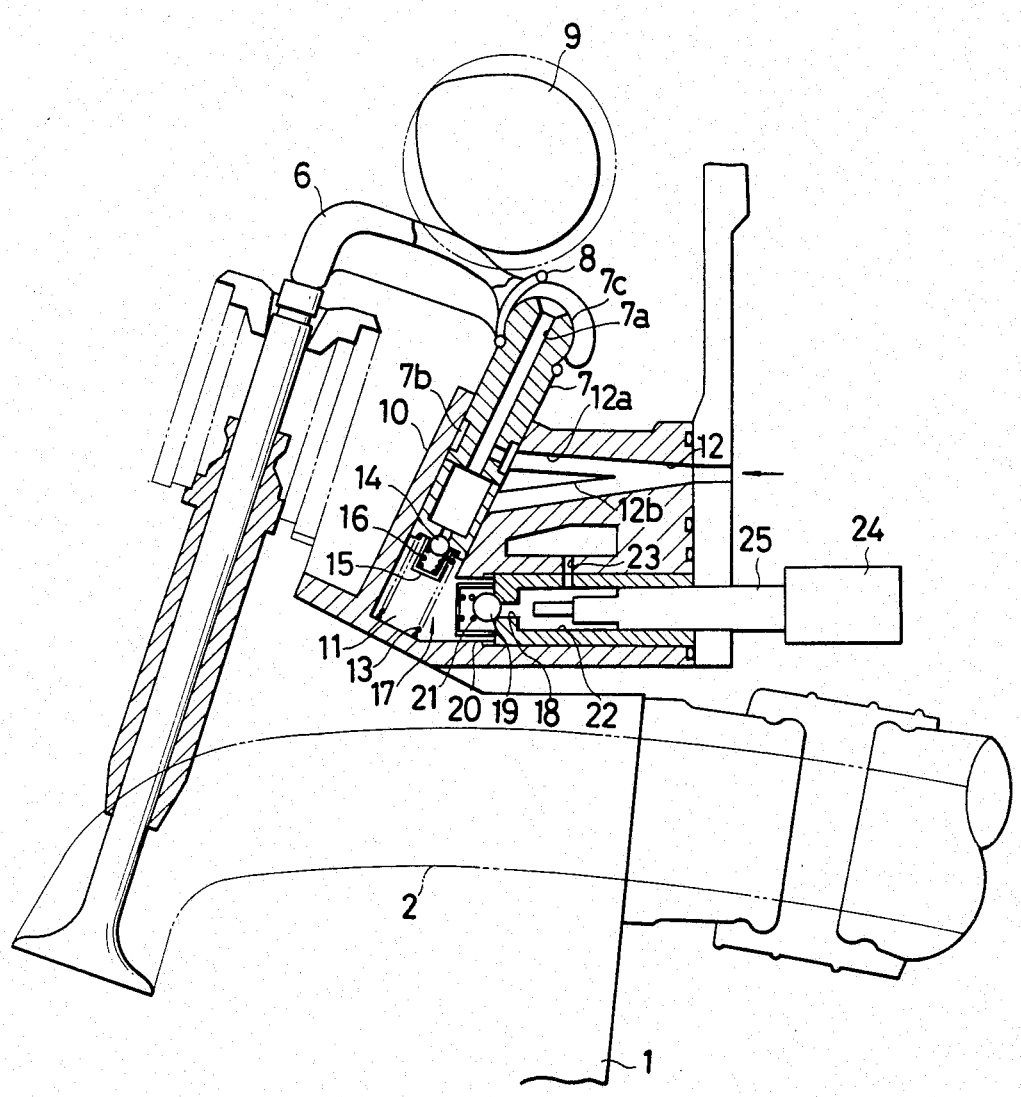
FIGS. 3 and 4 are sectional views showing an embodiment of the valve driving mechanism according to the valve driving control appratus of the invention.
Figure 4:
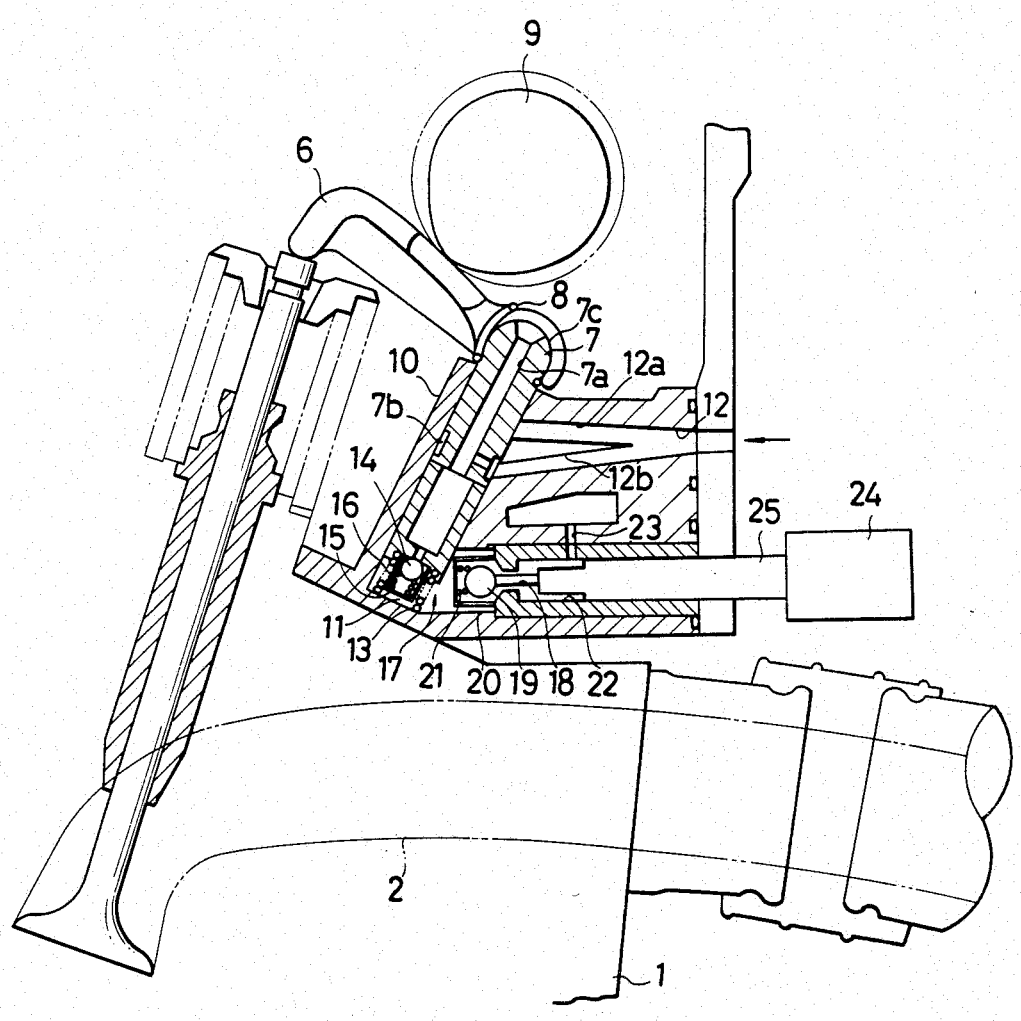

FIGS. 3 and 4 show an example of the valve driving mechanism which is utilized to drive either one of the intake valve 3 or the exhaust valves 5 which will be made inoperative. This valve driving mechanism is disclosed in the Japanese Patent application No. 56-176655 which was filed by the same applicant of the present invention. FIG. 3 shows the operative state of the valve and 4 shows the inoperative state of the valve respectively. As shown in FIGS. 3 and 4, a supporting end portion of the cam follower 6 is privotally supported by a spherical head 7*c* of a piston plunger 7. A spring 8 is places at this end portion of the cam follower 6 and wound around the neck portion of the spherical head 7*c* of the piston plunger 7 so as to secure this pivotally supporting end. The cam follower 6 contacts at its slipper portion 6*a* with the cam 9. The cam 9 is rotated in sychoronization with the engine revolution to intermittently press the cam follower 6 down, thereby the cam follower 6 intermittently opens the above-mentioned reciprocating valve.

The piston plunger 7 is slidably inserted into a fixed control cylinder 10 to form a pressure acting chamber 11. A hydraulic passageway 7*a* is formed in the pistong plunger 7 and axially passes there through. The hydraulic passageway 7*a* communicates with an annular groove 7*b* formed in the side wall surface of the piston plunger 7. A hydraulic pressure supplying passageway 12 opens at two points on the side wall of the fixed control cylinder 10. That is, the wall of the cylinder 10 is further formed with first and second hydraulic passageways 12*a* and 12*b* which are commonly continuously communicating with a suitable source (not shown) of a pressurized fluid and terminating in the wall of the cylinder 10. The respective terminal ends of the first and second passageways 12*a* and 12*b* are dispossed in such a manner as to open into the annular groove 7*b* in the piston plunger 7 when the piston plunger 7 assumes to be at predetermined first and second axial positions, i.e. the ascended and descended positions relative to the fixed control cylinder 10 as shown in FIGS. 3 and 4, respectively. Consequently, the fluid from the above-mentioned hydraulic source (not shown) is always supplied to the hydraulic passageway *7a*. The piston plunger 7 is urged in the direction of the cam 9 by a plunger spring 13 disposed in the pressure acting chamber 11. The piston plunger 7 is formed with a valve sheet at its opening portion of the hydraulic passageway *7a* at the upper end of the pressure chamber 11. A spherical valve body 14 is seated on this valve sheet by a small spring 16 provided in a retainer 15, defining at first one-way check valve means adapted to provide one-way communication from the axial hydraulic passageway *7a* of the piston plunger 7 to the pressure acting chamber 11 in the fixed control cylinder 10. A hydraulic exhaust opening 17 is formed on the side wall of the cylinder 10 which forms the pressure chamber 11. This hydraulic exhaust opening 17 extends in approximately radial direction of the cylinder 10 and communicates with a nozzle 18. The nozzle 18 is also provided with a spherical valve body 19 which is urged by a spring 21 housed in a cup-shaped retainer 20 and seated on the nozzle 18. Thus, a second onw-way check valve means. The nozzle 18 is communicated with a drain port 23 through a buffer chamber 26 which is formed in a guide cylinder 22. The guide cylinder 22 is equipped with a control plunger 25 which is driven by an electromagnitic solenoid 24. The plunger 25 has an elongated tip portion adapted to be axially inserted into the nozzle 18 upon exciting the electromagnetic solinoid 24 and pushes the spherical valve body 19 against the biasing force of the spring 21 to open the second check valve means.

In the valve driving apparatus according to the present invention with such a construction as described above, the electromagnetic solenoid 24 is de-energized when the reciprocating valve is to be operative. In this state, the hydraulic fluid is supplied to the hydraulic passageway *7a* through the hydraulic pressure supplying passageway 12, the fluid in the hydraulic passageway *7a* is supplied to the pressure chamber 11 through the first check valve. At this time, since the nozzle 18 has been bloced by the spherical valve body 19, the piston plunger 7 pibotally supports the cam follower 6 against the pressure of the cam follower 6, as the consequence, the reciprocating valve body is intermittently down in response to the rotation of the cam 9, thereby to effect the operation of the reciprocating valve.

On the other hand, when the reciprocating valve is to be made inoperative, the electromagnetic solenoid 24 is energized, so that the control plunger 25 is axially inserted into the nozzle 18 and further pushes the spherical valve body 19 to open the second check valve. In this state, the fluid in the pressure chamber 11 is drained from the hudraulic exhaust opening 17 through the nozzle 18, buffer chamber 26 in the guide cylinder 22 and further through the drain port 23 as shown in FIG. 4. Consequently, the piston plunger 7 sinks in the cylinder 10 when the cam follower 6 is pressed down by the cam 9 because the supporting force of the piston plunger 7 is no more present. The reciprocating valve 3 is therefore made inoperative as shown in FIG. 4. At this time, the piston plunger 7 is so pushed up by the plunger spring 13 in the direction of the cam 9 that the cam follower 6 always contacts at its slipper portion *6a* with the cam 9. In this state the hydraulic fluid which flows into or out of the pressure chamber 11 functions as a hydraulic damper for absorbing the vibration of the piston plunger 7. The resilient force of the plunger spring 13 has been set so weak that it won't allow the cam follower 6 to open the reciprocating valve.

In order to return the valve body from the inoperative state to the operative state, the electromagnetic solenoid 24 is de-energized. The control plunger 25 is then returned a position to close the second check valve and the hydraulic pressure in the pressure chamber 11 rapidly increases, so that the piston plunger 7 returns to a position to make the valve operative state as shown in FIG. 3. When the control plunger 25 returns and the piston plunger 7 is pushed up, the buffer chamber 26 in the guide cylinder 22 acts temporarily as the auxiliary oil vessel, which is advantageous for providing a rapid ascending motion of the piston plunger 7.

The above-described valve driving mechanism drives the intake or exhaust valve, selectively mading the valve inoperative in accordance with the control signal to be supplied to the solenoid 24. The valve driving apparatus according to the present invention has at least two of the valve driving mechanism of this type.

Figure 5:
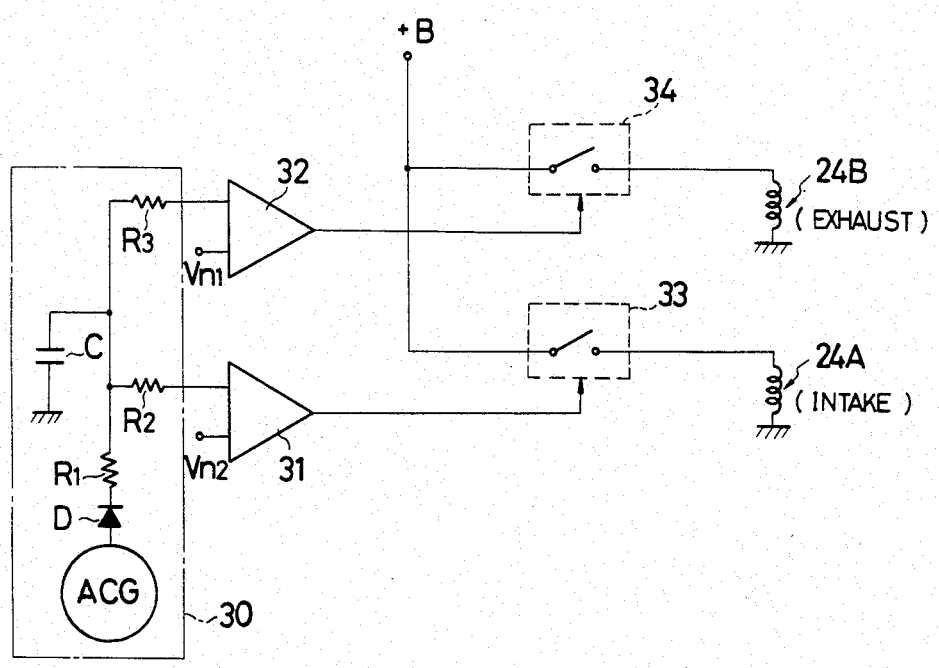
FIG. 5 is a circuit diagram showing a control circuit of the valve driving apparatus of the invention.

Referrence is now made to FIG. 5 which shows a control circuit for supplying control signals to the solenoid 24A of the valve driving mechanism of at least one of intake valves and to the solenoid 24B of the valve driving mechanism of at least one of exhaust valves of the valve driving control apparatus according to the present invention. This control circuit comprises a rotational speed voltage generating circuit 30 for generating the rotational speed voltage representative of the engine rotational speed. The rotational speed voltage generating circuit 30 in this embodiment comprised an AC generator ACG which rotates with the revoluting of an engine crankshaft, and a diode D, resistors $R_1$, $R_2$ and $R_3$ and a capacitor C which form a rectifier smoothing circuit to rectify and smooth the output of the AC generator. The rotational speed voltages produced by the rotational speed voltage generating circuit 30 are applied to a terminal of comparators 31 and 32, respectively. The comparators 31 and 32 compare the input voltages with reference voltages $V_{n2}$ and $V_{n1}$ and generate logical "0" signals respectively when the rotational speed voltages mentioned above are higher than reference voltage $V_{n1}$ and $V_{n2}$. These reference voltages $V_{n1}$ and $V_{n2}$ correspond to the values when the engine rotational speeds are $n_1$ and $n_2$, respectively. When the engine rotational speed is lower than the rotational speed $n_1$, both of comparators 31 and 32 generate logic "1" signals and when the engine rotational speed is higher than the ratational speed $n_1$, the comparator 32 outputs a logical "0" signal, while, the comparator 31 continuously produces a logic "1" signal. When the engine rotating speed is higher than the rotational speed $n_2$, both of the comparators 32 and 31 generate the logic "0" signal. Two switches 33 and 34 which are disposed in the power circuit of the solenoids 24A and 24B are closed by the logic "1" signals from the comparators 31 and 32 to energize the solenoids 24A and 24B.

Figure 6:
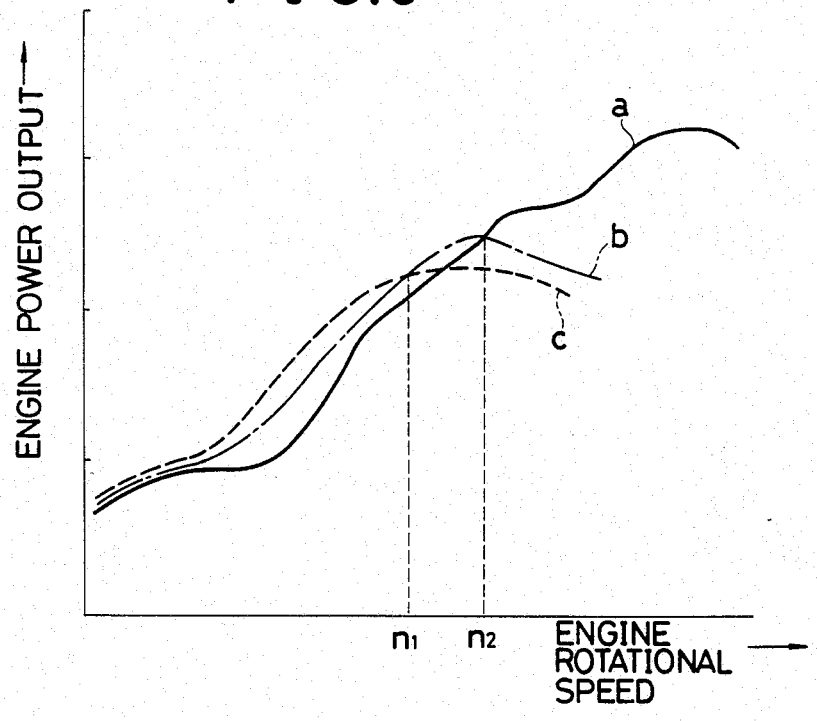
FIG. 6 is a graph showing the power characteristics of the internal combustion engine equipped with a plurality of intake and exhaust reciprocating valves.

FIG. 6 shows the relationship between the change of the engine power and the change of the engine rotational speed of the internal combustion engine including power cylinders each having two intake valves and two exhaust valves. In the drawing, a solid line 'a' shows the engine power characteristic in the case where all of intake and exhaust valves are operated, a portly dotted line 'b' indicated the engine power characteristic in the case where one of the intake valves is made inoperative while both fo exhaust valves are made operative, and a dashed line 'c' shows the engine power characteristic in the case where one of the intake valves and one of the exhaust valves are made inoperative and only the others of the intake and exhaust valves are made operative. As it is obvious from FIG. 6, the partly dotted line 'b' crosses the dashed line 'c' at the engine rotational speed $n_1$ and the solid line 'a' crosses the line 'b' at an engine rotational speed $n_2$.

As understood from the above description, the engine power can be increased by making a part of the exhaust valves inoperative in the idling state or at a low speed operation of the engine. However, with the increase in the engine rotational speed, the time duration where the exhaust valve is open is shortened and this causes an effect substantially the same as the inoperative state of the exhaust valve. In other words, it causes a similar effect as the case where the valve opening area is narrower since one of the exhaust valves is closed. Since a narrow opening area of the exhaust valves causes an exhaust resistance to be increased when the engine speed is higher than the engine speed $n_1$, it is necessary to make all exhaust valves operative in order to obtain higher engine power. In the case of the present invention, the opening area of the exhaust valves is made larger when the engine speed exceeds the speed $n_2$, it becomes possible to obtain a higher engine power.

According to the valve driving apparatus of the present invention, it is appreciated that the engine power characteristic shown by broken line 'c' is obtained when the engine rotational speed is in a low speed range lower than the speed $n_1$, and the engine power characteristic shown by the partly dotted line 'b' is obtained when the engine speed is in a medium speed range varying from $n_1$ to $n_2$, and that the engine power characteristic shown by the solid line 'a' is obtained when the engine speed is in a high speed range higher than the speed $n_2$. Thus, the change of the engine power characteristic depending upon the switching operation from the valve inoperative state of the valve to the operative state, is made continuous. This is advantageous because rapid change of the engine power which might be caused by the changeover operation between the inoperative and operative states of the valve can be eliminated.

With this detailed description of the specific apparatus used to illustrate the preferred embodiment of the present invention it will be obvious to those skilled in the art that various modifications can be made in the present system described herein without departing from the spirit and scope of the invention which is limited only by the appended claims.

What is claimed is:

1. A valve driving control apparatus for an internal combustion engine having a crankshaft and a power cylinder provided with a plurality of intake and exhaust valves, comprising:

(a) an engine speed sensor means for generating an engine speed signal indicative of the rotational speed of the crankshaft;

(b) a cam shaft driven by the crankshaft;

(c) a plurality of cam assembly means associated with said cam-shaft for opening one of the intake and exhaust valves in accordance with the rotation of said cam-shaft at a predetermined valve timing;

(d) a first change-over means associated with said cam assembly means for selectively disabling operation of opening the intake valve upon receiving a first valve drive control signal;

(e) a second change-over means associated with said cam assembly means for selectively disabling an operation of opening the exhaust valve upon receiving a second valve drive control signal; and (f) a control means for producing said first and second valve drive control signal in response to said engine speed signal, said control means being arranged to produce said first and second valve drive control signals when the engine speed is lower than a first reference level, and to produce only said first valve drive control signal when the engine speed is between said first reference level and a second reference level higher than said first reference level.

2. A valve driving control apparatus as claimed in claim 1, wherein said first and second change-over means comprise a control cylinder means associated with said cam assembly, powered by a pressurized fluid source, and a solenoid means driven by said valve control signal for opening and closing a control valve provided in a passageway which communicates said pressurized fluid source to said control cylinder means.

3. A valve driving control apparatus as claimed in claim 1 or 2, wherein said engine speed sensor means comprises an AC generator driver by the crankshaft, a rectifing and smoothing circuit connected to said AC generator to produce said engine speed signal in response to an output signal of said AC generator.

4. A valve driving control apparatus as claimed in claim 3, wherein said reclifying and smoothing circuit comprises a series circuit of a diode and a resistor, connected to an output terminal of said AC generator, and a capacitor connected between an output terminal of said series circuit and the ground.

5. A valve driving control apparatus as claimed in claim 1 or 2, wherein said control means comprises a first comparator which receives said engine speed signal and a second reference level signal and a second comparator which receives said engine speed signal and a first reference level signal having a voltage level lower than that of said second reference level signal, said first comparator being arranged to produce said first valve drive control signal when the voltage level of said engine speed signal is lower than that of said second reference level signal and said second comparator being arranged to produce said second valve drive control signal when the voltage level of said engine speed signal is lower than that of said first reference level signal.

* * * * *